US005284126A

United States Patent [19]

Varney

[11] Patent Number: 5,284,126

[45] Date of Patent: Feb. 8, 1994

[54] HIGH PERFORMANCE COMBUSTION HEATER

[76] Inventor: J. Arnold Varney, 7326 Ogelsby Ave., Los Angeles, Calif. 90045

[21] Appl. No.: 927,747

[22] Filed: Aug. 10, 1992

[51] Int. Cl.[5] ..... F24C 5/00

[52] U.S. Cl. ..... 126/50; 126/9 R; 126/9 B; 126/29

[58] Field of Search ..... 126/65, 29, 9 R, 4, 126/1 R, 30, 9 B, 66

[56] References Cited

U.S. PATENT DOCUMENTS

| | | | |
|---|---|---|---|
| 885,356 | 4/1908 | Miller | 126/29 |
| 2,573,211 | 10/1951 | Manzler | 126/9B |
| 2,820,446 | 1/1958 | Freeman | 126/9B |
| 2,877,759 | 3/1959 | Giese | 126/9 B X |
| 3,868,943 | 3/1975 | Hottenroth et al. | 126/9 R X |
| 4,915,091 | 4/1990 | Varney | 126/65 |

*Primary Examiner*—Larry Jones
*Attorney, Agent, or Firm*—Beehler & Pavitt

[57] ABSTRACT

A combustion heater/pot combination for rapid and efficient heating of liquids and foodstuffs comprises a cylindrical shell enclosing both a heat source and a container whereby products of combustion are constrained to flow through an annular flue defined by the shall wall and the container within and spaced from the shell wall by guide elements. The shell is elevated above a support surface, such as the ground or a hearth, by a plurality of struts, whereby air is admitted to a combustion zone. The struts are releasably engaged to the shell by structures which assure stability of attachment. Combustion air preheat and/or draft control shells resting on the support surface may embrace the shell strut combination for improved efficiency.

51 Claims, 5 Drawing Sheets

Fig. 14
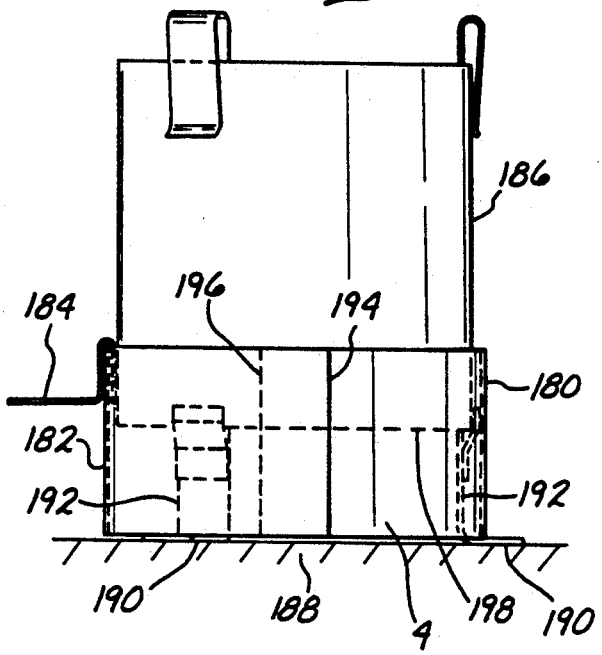
Fig. 16
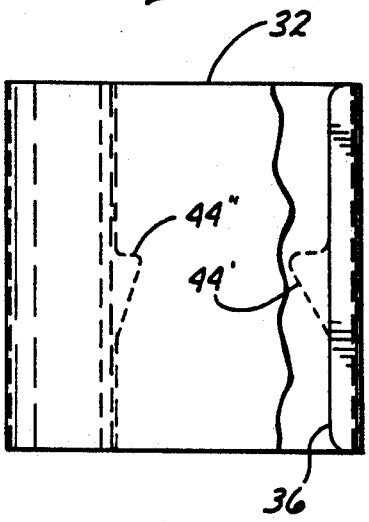
Fig. 15
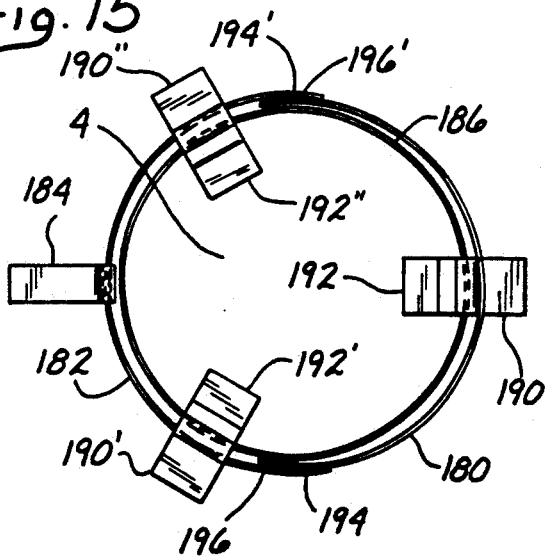
Fig. 17
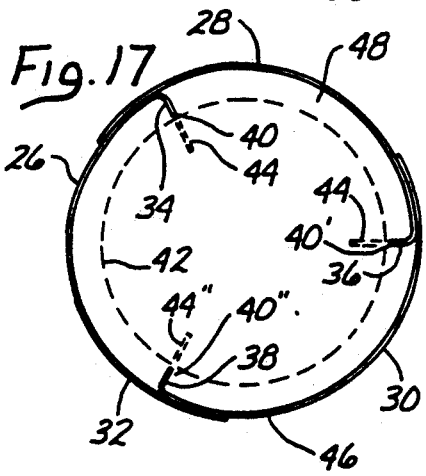
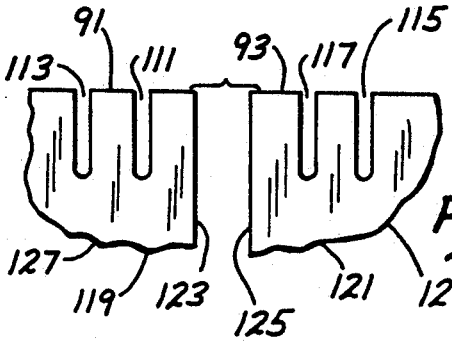
Fig. 25
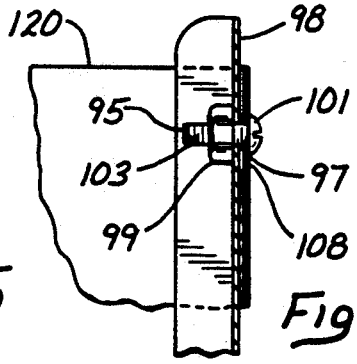
Fig. 24

Fig. 18
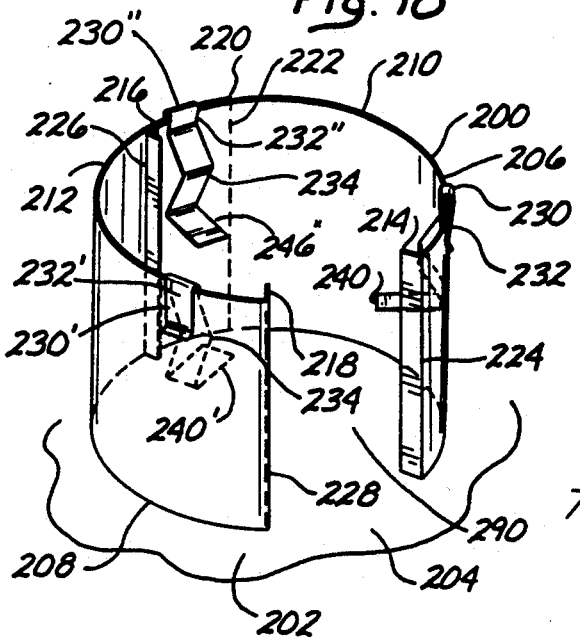
Fig. 19
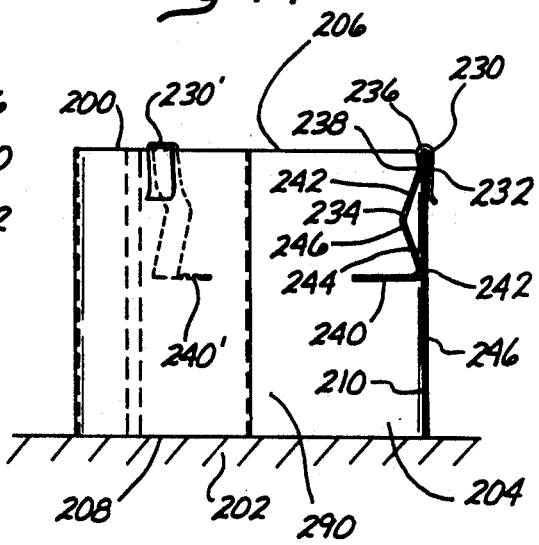
Fig. 20
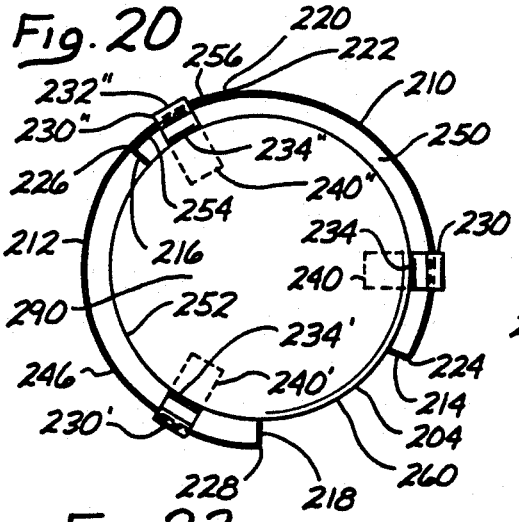
Fig. 21
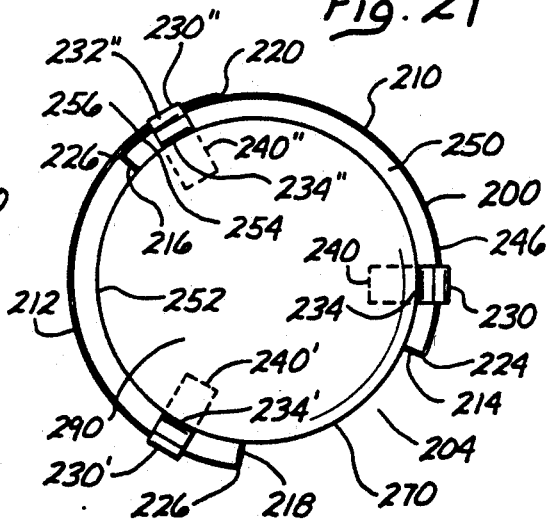
Fig. 22
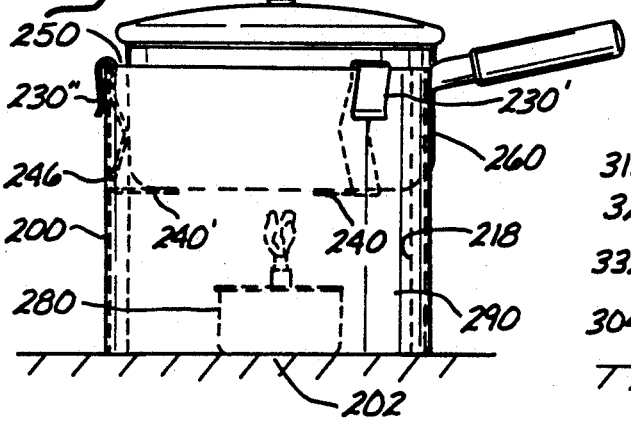
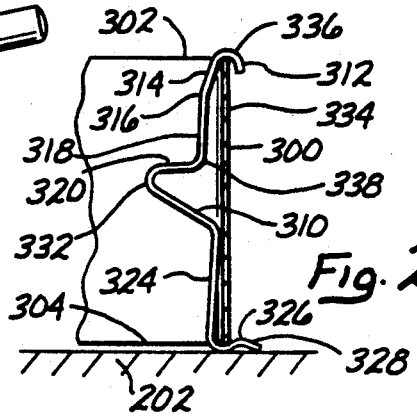
Fig. 23

HIGH PERFORMANCE COMBUSTION HEATER

BACKGROUND OF THE INVENTION

1. Field of the Invention

The invention relates generally to combustion heaters and is more specifically directed to portable stoves for heating water and foodstuffs in containers adapted for use in conjunction with such stoves under relatively primitive conditions such as camping or in adverse conditions such as disaster or emergency situations.

2. Description of the Prior Art

The stove or heater invention set forth and depicted herein represents evolutionary advance over the prior art as disclosed in U.S. Pat. No. 4,915,091 for "High Efficiency Combustion Heater" dated Apr. 10, 1990. This prior art patent sets forth principles of design for construction of a class of combustion heaters of markedly improved efficiency both of combustion,,especially of wood as fuel and of heat transfer to the container to be heated. The present invention embodies improvements which overcome problems noted through wide-spread field experience with prior art heaters.

BROAD OBJECTIVES OF THE INVENTION

A primary object of the invention is to provide heaters basically following design principles set forth in the prior art disclosures but which can readily be assembled with a predetermined and well-defined exhaust flue annulus, even by users not previously experienced or trained in assembly of the stove. It has been found that in adjusting the effective diameter of the flue shell to a pot of given diameter, users may mistakenly produce a flue annulus, that is, the annular space between the pot and the surrounding shell, which is insufficient for adequate flow of exhaust gases, thus inhibiting intake flow of combustion air with resulting inefficient and suppressed combustion. On the other hand, lack of awareness of the importance of a proper flue annulus may result in too great a space between pot and flue shell, resulting in relatively languid flow of flue gases along the wall of the pot and consequent lessened rate of heat transfer from hot gases to the pot. The present invention provides spacing means which allow immediate and direct recognition of optimal flue annulus width and consequent quick and convenient adjustment of flue shell diameter to suit a particular pot to be used. If that pot is of diameter outside the range of adjustment of the particular stove flue at hand, this fact can be readily determined by trial.

A further object of the invention is to provide improved stability of struts which raise the flue shell above the support surface on which the stove rests in use, such as the ground or a hearth.

A further object of the invention is to provide improved structural means of support of heavily laden containers placed in or on the stove for heating.

A further object of the invention is to provide means for quickly and securely attaching struts to a shell without use of separate fasteners, that is, securing devices which are separate from the elements to be joined and therefore prone to loss in the field by reason of diminutive size, such as accessory screws, nuts and bolts.

A further object of the invention is to provide secure means of attachment of struts to a shell, which means also provide ready adjustment of effective shell diameter to adapt the shell to the diameter of the particular pot to be used.

A further object of the invention is to provide combustion heaters of the class described the structural integrity of which is substantially unaffected by repeated exposure to intense heat.

A further object of the invention is to provide a heater of the class described which when assembled can be moved from one place, such as a hearth, to another and back again without loss of structural integrity.

A further object of the invention is to minimize the number of separate components comprising a complete stove, whereby facility of warehousing, transportation, assembly and disassembly in the field are enhanced and cost minimized.

SUMMARY OF THE INVENTION

The heater of the present invention comprises a shell for encompassing a combustion heat source resting on a supporting surface and a number of strut-like members attached to the shell to support the shell a predetermined height above the support surface, which may be the ground or a hearth, for instance. The space between the shell and support surface is provided for the primary purpose of admitting combustion air to the fuel of the heat source. The opening thus created between the supporting surface and the lower edge or rim of the shell may also be used for introduction of fuel pieces, such as wood, or burners using liquid or jelled fuel or gas. A primary, but not the only, use of the heater herein disclosed and depicted is for rapid and efficient heating of water and cooking oil and foodstuffs in a container largely surrounded by the aforementioned shell.

In a preferred form of the invention, strut-like members extend from the support surface to and above the upper rim of the shell and are attached to the shell at both upper and lower rim portions of the shell for maximum stability of attachment. Each strut includes a foot-like member for spreading the area of contact of the strut on the support surface, which in practice may be soft sand, dirt, gravel or accumulated ashes from previous fires. Thus a considerable load may be carried by such foot with minimal sinking in such soft or shifting surface.

In a preferred form of the invention, each unitary strut also includes an element which provides support for a vessel or pot which may be placed in the shell as well as an element which spaces the side wall of such a container from the shell wall so that hot gases rising from the heat source, such as a fire, are constrained to flow through what constitutes an annular flue. Three or more such struts spaced approximately equidistant about the circumference of the shell provide both stable support for the shell and pot and effective means of centering a pot of circular planform in a cylindrical shell. A shell comprising a single, elongate, relatively flexible sheet of metal formed so that its free ends overlap to form a cylindrical body can readily be expanded or contracted in diameter simply by varying the degree, of such overlap. In a preferred form of the invention, such overlap is retained in any desired degree of overlap by gripping or clamping means associated with a strut attached to the shell in the area of overlap. Thus it is readily possible to adjust the effective diameter of the shell to adapt to a given pot, within the limits of expansion or contraction of the formed flexible sheet comprising the shell. A shell comprising a plurality of three or more equal flexible segments, each pair of such segments assembled so as to have overlapping edge portions retained in faying relationship by the gripping or clamping means associated with a strut of the novel design herein set forth and depicted, has been found to provide a desirable range of adjustability combined with container centering as well as stable support of both pot and shell.

A novel method and means for rapid and secure attachment of the above-noted strut members to upper and lower edge or rim portions of the shell is disclosed and depicted herein. Preferred structures for this purpose provide for infinite adjustment of shell working diameter within limits determined by the size and flexibility of the sheet material of which the shell is, or the shell segments are, formed. Shells comprising a plurality of arcuate segments exhibit significantly greater range of adjustment of diameter since each area of overlap of such segments provides latitude for varying the degree of overlap retained by the gripping or clamping means of the strut members. The novel method involving discrete steps for attachment of a strut to a shell may also be employed with structures which provide for incremental, rather than infinite, adjustment of shell diameter. Both types of attachment structure and the novel method of attachment employed therewith require no hand tools in assembly of a heater of the present invention. Both types of such structures are described herein under DETAIL DESCRIPTION OF THE PREFERRED EMBODIMENTS.

Both types of attachment structures involve and require the same separate and discrete steps for engagement of a strut of the novel design herein described and depicted to a heater shell of the present invention. Initially, the strut is juxtaposed to the shell in an attitude substantially parallel to the axis of the shell. The strut is then moved longitudinally with respect to the axis of the shell to engage a clamping or gripping means near one end of the strut with the adjacent rim or edge portion of the shell. Subsequently, the strut is moved in the opposite direction with respect to the shell to engage clamping or gripping means near the other end of the strut with the other edge or rim portion of the shell. As will become apparent in the detail description of the drawings and preferred embodiments of the invention, spacing of the strut attachment means relative to each other and relative to the distance between opposite edge or rim portions of the shell is an essence of this generic and novel means end method of attachment of strut to shell.

A further method and alternate structure for attachment of a strut to a shell according to the present invention involves a single longitudinal movement of the strut relative to the shell after insertion of a stud or fastener in the vicinity of each end of the strut into keyhole slots fashioned in the shell wall at positions near the upper and lower rim portions of the shell, such keyhole slots positioned so as to match the relative positions of the studs or fasteners in the strut. Again, the strut is juxtaposed to the shell so that the studs or fasteners may be inserted through their respective keyhole slots. The strut is then moved longitudinally with respect to the shell so that the studs or fasteners at each end of the strut move simultaneously and in the same direction along the keyhole slots to complete the engagement. In the case in which fasteners such as screws with nuts are employed, the fastener may be tightened to achieve semi-permanent or even permanent assembly of strut to shell.

A feature of the novel strut means of the present invention is incorporation of multiple functions in a unitary strut member. A single unit provides for elevation of the shell above a support surface, as noted above, attachment of the strut to the lower edge of the shell, support of a pot which may be positioned within the shell for heating, spacing of the pot away from the shell wall, and attachment of the strut to the upper edge or rim portion of the shell. A preferred form of the unitary strut of the present invention also includes an upward projection relative to the shell upper rim when installed as a functioning part of the assembled stove. This projection, in concert with such projections on each of the other struts in a completely assembled stove of the present invention, may serve as supports for a relatively large diameter utensil, such as a frying pan, hotplate or Chinese wok, resting on the stove but elevated above the shell rim by such projections to allow escape of products of combustion. This upward projecting portion of the strut in a preferred form of the invention also serves as a clamp for yielding engagement of the upper rim portion of the shell, as will be clear in subsequent detail description of the preferred embodiments.

In a further preferred embodiment of the invention, each of a plurality of strut-like members extending from the support surface on which the heater rests to or beyond the upper rim of a cylindrical shell is secured to the shell by a single fastener located approximately midway between the upper and lower rims of the shell. Complete stability of each strut, that is, inability of the attached strut to move rotationally about its single point of fastening to the shell, is assured in tripartite construction of the shell wherein one end of each shell segment is flanged inwardly toward the centerline of the cylindrical shell, by positioning each strut adjacent a flange of the shell so that either the upper end or the lower end portion of the strut strikes the flange if angular displacement of the strut is initiated. Thus, each strut attached in such an embodiment of the invention is fixed securely in an orientation substantially normal to the plane of the upper rim and to the the plane of the lower rim of the cylindrical shell.

As will be appreciated by reference to the cited prior art patent disclosure, the present inventive heater can be enhanced in thermodynamic efficiency by enclosing the flue shell within an outer shell or enclosure resting on the support surface on which the heater is disposed so that combustion air, drawn into the combustion zone under the influence of convection, flows downward in the space or spaces between the heater flue and such enclosure, thus preheating such combustion air and thereby enhancing the combustion process when the fuel is wood or other fuel undergoing pyrolysis in the combustion process. Such an enclosure in the form of outer shells movable with respect to the flue shell may also serve the important function of draft control, also as set forth in the prior art disclosures.

BRIEF DESCRIPTION OF THE DRAWINGS

FIG. 14 is a side elevation view of a heater constructed according to the present invention including movable arcuate closure means embracing the heater shell body and struts.

FIG. 15 is a top plan view of the heater with closure means depicted in FIG. 14.

FIG. 16 is a side elevation view partially in section of a tripartite shell constructed according to the present invention and cut away to reveal one of three inwardly directed flanges.

FIG. 17 is a top plan view of the shell of FIG. 16 in which inwardly directed flange elements of the three arcuate shell segments are depicted along with a phantom plan outline of a pot within the shell.

FIG. 18 is an isometric view partially in section taken from above a combustion heater constructed according to the present invention adapted especially for use with burners for gas or liquid fuels such as diethylene glycol.

FIG. 19 is a side elevation view of the heater of FIG. 18.

FIG. 20 is a top plan view of the heater of FIG. 18 including the body only of a pot shown centered in the heater shell.

FIG. 21 is a top plan view of the same heater as depicted in FIG. 20 but expanded in effective diameter by a pot of larger diameter than that shown in FIG. 20.

FIG. 22 is a side elevation view rotated 60° counterclockwise of the heater depicted in FIG. 18 including a cooking vessel and burner such as is commonly available.

FIG. 23 is a side elevation view of a fragment partially in section of a heater shell, as depicted in FIG. 19, including a unitary element providing support and spacing of a pot within the heater.

FIG. 24 is a side elevation view partially in section of a fragment of the structure depicted in FIG. 11.

FIG. 25 is a frontal elevation view of adjacent fragments of end portions of a sheet, or sheets, formed into a cylinder, or segments of a cylinder, prior to overlapping and securing such end portions by engagement means associated with a strut as depicted in FIG. 10, FIG. 11 and FIG. 12.

DETAIL DESCRIPTION OF THE PREFERRED EMBODIMENTS

Figure 1:
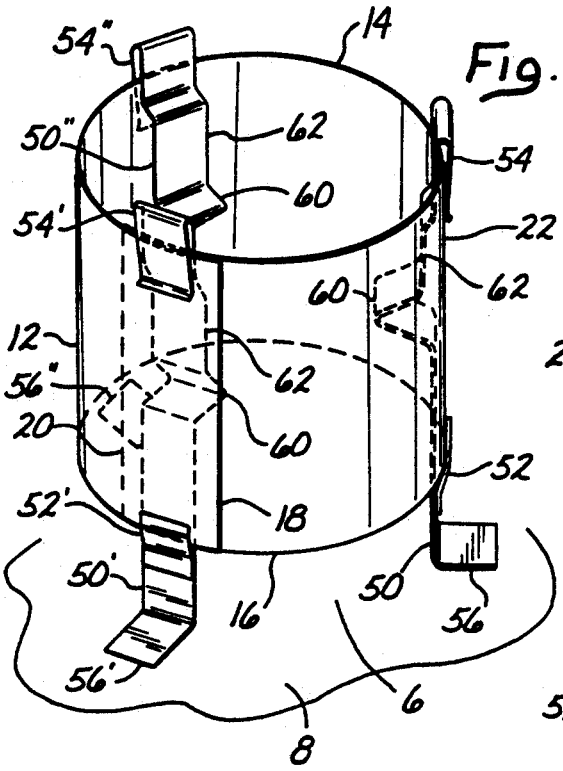
FIG. 1 is an isometric view taken from above a combustion heater constructed according to the present invention.

With reference to the drawings, FIG. 1 shows a combustion heater in a basic embodiment of the present invention including a tubular shell 12 open at both ends and terminating in upper rim 14 and lower rim 16. Lower rim 16 of tubular shell 12 is elevated above support surface 8, which may be the ground or a hearth or the like, by unitary struts 50, 50′ and 50″ extending from support surface 8 to a level adjacent upper rim 14 of shell 12. Strut 50, strut 50′ and strut 50″, spaced approximately 120° apart around tubular shell 12, provide stable support for shell 12 spaced above support surface 8, as best seen in side elevation view partially in section, FIG. 2.

Unitary with each of identical struts 50, 50′ and 50″ are lower engagement means 52, 52′ and 52″, respectively, for support of shell 12 by gripping lower rim 16 of tubular shell 12, and upper engagement means 54, 54′ and 54″, respectively, for gripping upper rim 14, whereby strut 50, strut 50″ and strut 50″ may be stabilized and attached securely yet removably to shell 12 in orientation substantially normal to upper rim 14 and lower rim 16. When strut 50, strut 50′ and strut 50″ are thus attached to shell 12, the complete heater assembly may be placed on support surface 8 in readiness for use. As in the prior art stoves, shell 12 is elevated above support surface 8, as best seen in side elevation view FIG. 2 and FIG. 3, in order to provide access for combustion air to enter combustion zone 6 for support of a fire therein and to provide for ready insertion of fuel pieces, initially for building a fire and subsequently for maintaining the fire as needed.

Figure 2:
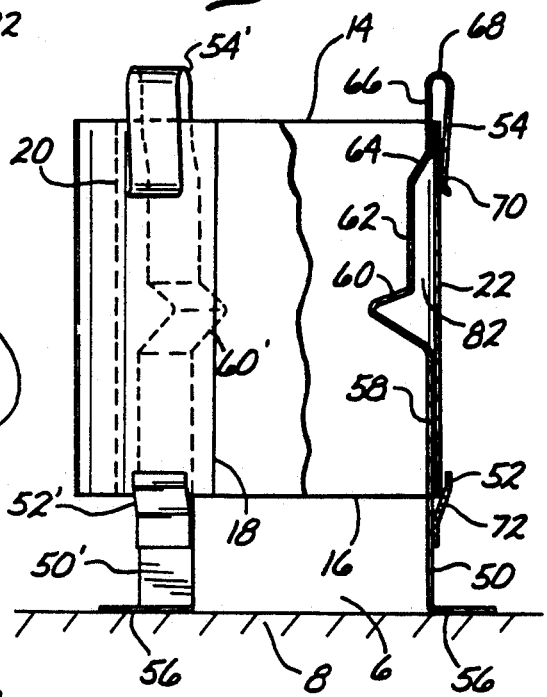
FIG. 2 is a side elevation view partially in section of a heater constructed according to the present invention.
Figure 3:
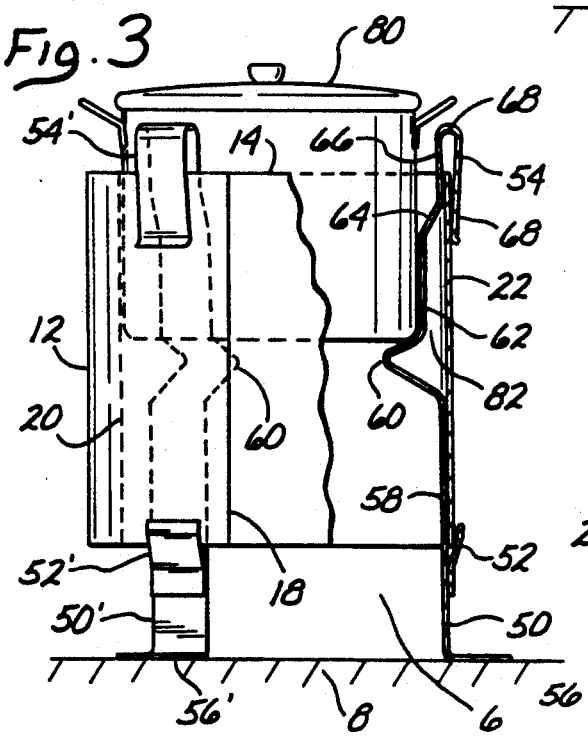
FIG. 3 is a side elevation view partially in section of a heater constructed according to the present invention including a container or pot shown in place for heating a substance.
Figure 4:
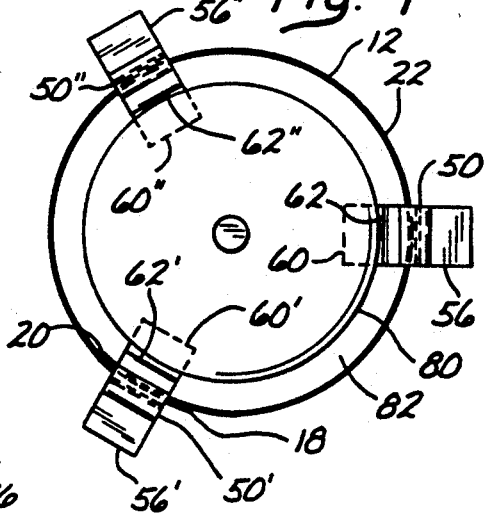
FIG. 4 is a top plan view of the heater shown in FIG. 3 including a cooking utensil as shown in FIG. 3 but with cover and handles of the cooking utensil removed for clarity of depiction.

FIG. 1, FIG. 2. FIG. 3 and FIG. 4 depict tubular shell 12 constructed of a single sheet of flexible metal, such as light gage sheet iron or stainless steel, formed cylindrically so that vertical edge portion 18 lies outside the opposite edge portion 20 of shell 12 and therefore the respective edge portions overlap, as shown adjacent strut 50′. The degree of overlap may be varied considerably, depending on the gage and hardness and therefore flexibility of the sheet material employed, and held in any desired condition of overlap by the clamping of upper engagement means 54′ and lower engagement means 52' associated with strut 50'. Thus, the effective diameter of shell 12 may be adjusted to conform to a range of diameters of pots for use with the stove.

An alternate mode of constructing shell 12 according to the present invention is depicted in FIG. 16 and FIG. 17 in which are shown three arcuate segments 26, 28 and 30, respectively, assembled with overlapping vertical edge portions so as to form an essentially cylindrical shell body 32. The diameter of shell body 32 can be effectively expanded or contracted by varying the degree of overlap at each of three areas of overlap. Clamping the faying portions of adjacent segments 26, 28 and 30 by means of lower engagement means 52, 52' and 52", respectively, and upper engagement means 54, 54' and 54", respectively, of struts 50, 50' and 50", respectively, as depicted in FIG. 1, FIG. 2, FIG. 3 and FIG. 4, at each respective overlap area produces an effectively cylindrical body of diameter dependent on the degree of overlap at each of the three faying areas. By virtue of a plurality of areas of adjustable overlap, tripartite construction of shell 12, as shown in FIG. 16 and FIG. 17, provides markedly increased adjustability of effective diameter of shell 12 relative to the extent of adjustability provided in the case of shell 12 formed from a single sheet with a single area of overlap. Where no adjustability of shell diameter is required, as would be the case of a heater constructed according to the present invention but designed to accommodate a single vessel of known diameter, cylindrical shell 12 can, of course, be seamless or fabricated with a single fixed vertical joint or fabricated of a suitably heat-resistant material such as pottery or cast iron.

Tripartite shell body 32 of FIG. 16 and FIG. 17, comprising three identical segments 26, 28 and 30, may also include flange elements 34, 36 and 38, respectively, the free edges 40, 40' and 40", respectively, of which serve as guides to space a pot 42, shown schematically in phantom plan view in FIG. 17, from wall 46 of shell 32 as pot 42 is lowered into shell 32 to be seated on pot support means such as projections 44, 44' and 44", respectively. Each of flange elements 34,, 36 and 38 thus designed to include pot support means such as projections 44, 44' and 44", respectively, would provide stable support for a pot placed in the stove for heating. Projections 44, 44' and 44", extending from flanges 34, 36 and 38, respectively, are represented by broken lines in FIG. 16 and FIG. 17 since such pot support means are but one of a number of alternative pot support means hereinafter described and depicted. A pot resting on pot support means 44, 44' and 44" and centered in shell 32 by flange elements 34, 36 and 38 provides an adequate flue annulus 48 for escape of products of combustion from a fire beneath the pot.

Returning to FIG. 2, depicted in side elevation partly in section is the heater shown isometrically in FIG. 1. A portion of shell 12 has been cut away to reveal strut 50 which, as previously noted, is identical to struts 50' and 50". Shown in section, strut 50 is attached to wall 22, also in section, of shell 12 by lower engagement means 52 and upper engagement means 54 of strut 50. In a preferred form of the invention, strut 50 is unitary, extending from, and including, foot 56 to, and including, upper engagement means 54. Strut 50 comprises foot element 56 for resting on support surface 8; shell support or lower engagement means 52, which may be integral with or permanently joined to strut 50; vertical element 58 extending from foot element 56 to pot support element 60; pot support element 60; pot spacing element 62 and intermediate element 64 joined to inner clip element 66 in turn joined to outer clip element 70 through bend 68 to form upper engagement means 54.

Figure 8:
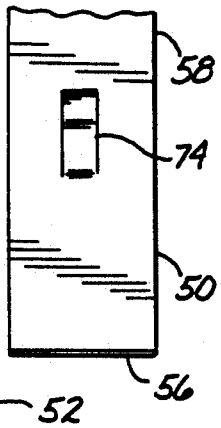
FIG. 8 is a frontal elevation view, somewhat enlarged relative to the depictions of FIG. 5, FIG. 6 and FIG. 7, of a lower end fragment of a strut constructed according to the present invention.
Figure 9:
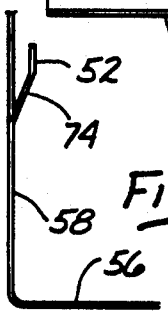
FIG. 9 is a side elevation view of the strut fragment depicted in FIG. 8.

FIG. 2 depicts lower engagement means 52 comprising jamming element 72 extending outward and upward at an acute angle with respect to strut 50 and joined to strut 50 by spotwelding, furnace brazing, riveting, bolting or otherwise. FIG. 8 and FIG. 9 depict lower engagement means 52 in an alternate form in which jamming element 74 is integral with strut 50, that is, stamped from the parent material from which strut 50 is fabricated, and forming an acute reentrant angle with vertical element 58 of strut 50. Thus, when lower rim 16 of shell 12 is thrust into engagement with lower engagement means 52, a jamming action takes place, inducing a high degree of frictional engagement between lower rim 16 of shell 12 and strut 50. Frictional engagement is maintained even when the materials of shell 12 and strut 50 are at high temperature or have been annealed from exposure to intense heat.

Vertical element 58 of strut 50 serves to space pot support element 60 a predetermined height above support surface 8. A pot, therefore, such as pot 80 depicted in FIG. 3, is elevated sufficiently above a fire from fuel resting on support surface 8 to assure efficient combustion of such fuel in combustion zone 6 beneath pot 80. Pot support element 60 is a V-shaped portion of unitary strut 50, so shaped for structural properties to carry the load of a heavily laden pot as well as for ease of fabrication by common stamping or bending operations. The V-form also allows nested stacking of three or more struts for compact stowage in transport of unassembled or disassembled heaters constructed according to the invention.

Pot spacing element 62 of strut 50 lies substantially parallel to wall 22 of shell 12 and is spaced therefrom a predetermined distance by its juncture with pot support element 60 and by intermediate element 64 joined with inner clamp element 66 which bears against the upper rim area of wall 22 of shell 12. Pot spacing element 62 serves to predetermine a minimum space between a pot, such as pot 80 depicted in FIG. 3 and FIG. 4, and wall 22 of shell 12, whereby adequate width of flue annulus 82 is preserved whenever shell 12 is adjusted in diameter to suit pots of differing diameters. Pot spacing elements 62, 62' and 62" of struts 50, 50' and 50" respectively, serve as guides to the user in adjusting the effective diameter of shell 12 to fit a given pot so that the pot to be used may slide freely into place resting on pot support elements 60, 60' and 60" of struts 50, 50' and 50" and yet be guided to a substantially coaxial location within cylindrical shell 12.

Figure 5:
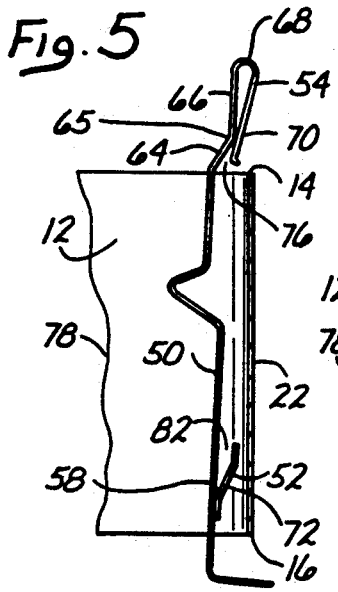
FIG. 5 is a side elevation view of a strut constructed according to the present invention and positioned adjacent a sectional view of a fragment of the wall of a shell which forms the body of a heater assembly constructed according to the present invention. The space relationships of strut and shell shown in FIG. 5 represent the first of three steps which comprise a novel method of attaching a strut element to the shell body of the heater of the present invention.
Figure 6:
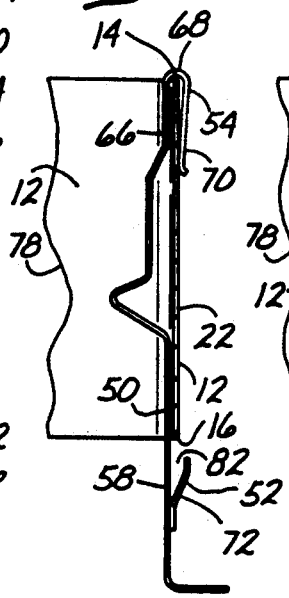
FIG. 6 depicts the space relationship between strut and shell body in the second of three steps which comprise a novel method of attaching a strut to the shell body of the heater of the present invention.
Figure 7:
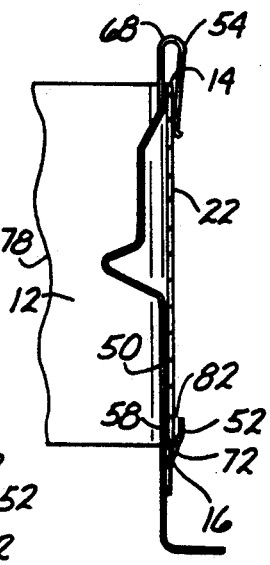
FIG. 7 depicts the space relationship between the strut and shell body in the third and final one of the three steps for attaching a strut to the shell body.

FIG. 5, FIG. 6 and FIG. 7 depict a series of steps comprising a novel and generic method of attachment of strut 50 to shell 12 or to any sheet material exhibiting a modicum of rigidity in the direction of the long dimension of strut 50, either by virtue of inherent properties or by virtue of section properties as pertain to a curved sheet, for instance. Thus, it is found practical to employ strut 50 in conjunction with shell 12 fabricated of very thin and therefore inherently flexible sheet metal such as shim stock which when formed as a cylinder, or arcuate segment of a cylinder, presents entirely adequate structural rigidity or column strength to serve well in cooperation with strut 50 incorporating upper engagement means 54 and lower engagement means 52.

Referring to FIG. 5, a fragmentary segment 78 of shell 12 is shown in vertical section in the area where strut 50 will be attached. Strut 50 is shown positioned adjacent the sectioned area of shell 12 in readiness for subsequent steps in the aforementioned series of steps. Such positioning of strut 50 adjacent shell 12, in an attitude substantially normal to upper rim 14 and lower rim 16 of shell 12, represents the first step in the novel method herein set forth and depicted. It will be observed in FIG. 5 that outer clamp element 70 of upper engagement means 54 is shown bearing against juncture 65 of inner clamp element 66 and intermediate element 64. When upper engagement means 54 is in a free state, that is, when upper engagement means 54 is not engaged with upper rim 14 of shell 12, outer clamp element 70 bears yieldingly against juncture 65 of inner clamp element 66.

The second step in the method, the result of which is depicted in FIG. 6, involves introducing rim 14 of shell 12 into reentrant 76 between intermediate element 64 of strut 50 and outer clamp element 70 of engagement means 54 with subsequent thrusting of yielding engagement means 54 downward over rim 14 of shell 12 so that outer clamp element 70 is pried away from inner clamp element 66 sufficiently to allow upper engagement means 54 of strut 50 to slide downward relative to rim 14 and wall 22 of shell 12 until bend 68 of engagement means 54 contacts rim 14 of shell 12, thus terminating such relative movement between strut 50 and shell 12 and completing the second step of the novel method herein described and depicted. It will be understood that inner clamp element 66, bend 68 and outer clamp element 70 are all of yielding properties which contribute to the ability of upper engagement means 54 to be driven or thrust down over rim 14 of shell 12 to arrive at the relative positions of strut 50 and shell 12 as depicted in FIG. 6.

At the relative positions of strut 50 and shell 12 as depicted in FIG. 6, in which relative positions bend 68 of strut 50 has limited downward movement of strut 50 relative to shell 12, lower engagement means 52 is in space relationship with lower rim 16 of shell 12 such that lower engagement means 52 may be engaged with lower rim 16 of shell 12 by upward movement of strut 50 relative to shell 12. Such upward movement represents the third step in the method herein set forth and depicted for attachment of strut 50 to shell 12. FIG. 7 depicts the result of such third step involving relative movement of strut 50 and shell 12 in a direction substantially opposite to such relative movement involved in the second step of the method, described above. FIG. 7 depicts the result of such third step in which lower rim 16 of shell 12 is first introduced into reentrant 82 between jamming element 72 and vertical element 58 of strut 50 and finally driven home to a jammed relationship between lower rim 16 of shell 12 and lower engagement means 52. It will be observed that in such jammed relationship between lower rim 16 and lower engagement means 52, strut 50 has moved relative to shell 12, to a position which raises bend 68 of upper engagement means 54 relative to upper rim 14 of shell 12, but retains the clamping or gripping relationship between upper engagement means 54 and the upper rim area of shell 12 adjacent upper rim 14. Therefore, as the end result of the three successive steps of the method herein set forth and depicted, strut 50 is securely fixed to shell 12 at both upper and lower rim areas of shell 12, and strut 50 is in a stable and substantially vertical attitude when the fully assembled heater of the present invention is placed on a substantially horizontal support surface, ready for use.

Attention is directed to a feature of the inventive strut means herein described and depicted which is of significance to overall utility of the heater of the present invention, namely, that elevation of bend 68 of strut 50 above upper rim 14 of shell 12 in the installed position of strut 50 as depicted in FIG. 7, as well as in FIG. 1, FIG. 2, FIG. 3 and FIG. 14, provides for support of a relatively broad cooking vessel such as a large frying pan, a hotplate or Chinese wok to rest on the heater for cooking without closing off the flue of shell 12 from which products of combustion from a fire within the heater must be free to escape.

Figure 10:
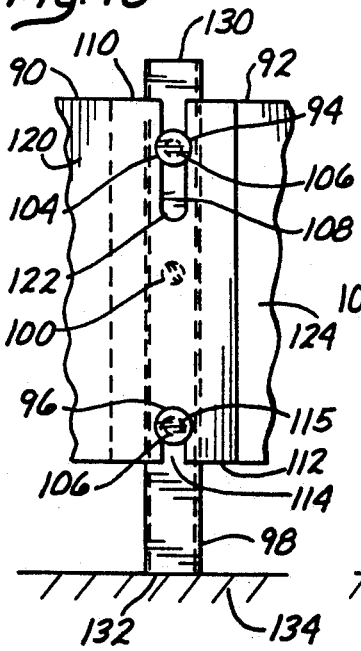
FIG. 10 is a frontal elevation view of a fragment of an alternate shell of a heater constructed according to the present invention and a strut attached thereto by engagement means alternate to those engagement means depicted in FIG. 1 through FIG. 9.
Figure 11:
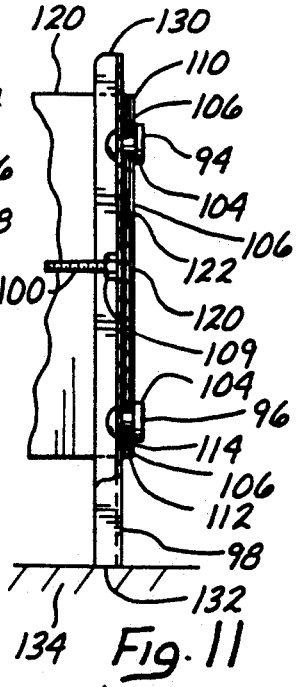
FIG. 11 is a side elevation view partially in section of the structure depicted in FIG. 10.
Figure 12:
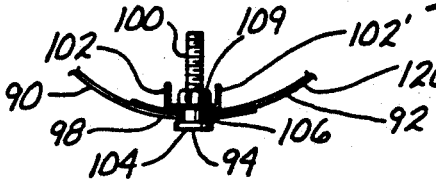
FIG. 12 is a top plan view of the structure depicted in FIG. 10 and FIG. 11.

FIG. 10, FIG. 11 and FIG. 12 depict alternate structure for attachment of strut 98 to a shell 120 as employed in the present invention and involving for such attachment the generic method and series of steps hereinbefore set forth and depicted in FIG. 5, FIG. 6 and FIG. 7. Shell fragment 90 and shell fragment 92 of complete cylindrical shell 120 are shown in overlapping relationship, as is the condition of adjacent shell segments in a tripartite shell configuration as depicted in FIG. 17 or, similarly, the condition of the ends of a single formed sheet of metal with ends overlapping to comprise an essentially cylindrical body with upper rim 110 and lower rim 112. Upper rim 110 incorporates slot 108, and lower rim 112 incorporates slot 114, hereinafter described in detail. FIG. 11 is a partially sectioned view of the structure of FIG. 10, such sectional view taken through the common centerlines of slots 108 and 109. Stud 94, stud 96, screw 100 and nut 109 are shown not in section, for clarity of depiction.

FIG. 12 is a top plan view of the structure depicted in FIG. 10 and FIG. 11. FIG. 12 shows with particular clarity that strut 98 in this embodiment of the invention is a channel-section element with flanges 102 and 102' projecting inward with respect to shell 120. Flanges 102 and 102' provide not only structural rigidity to strut 98 but, of particular significance to the present invention, serve as spacing means whereby a pot situated in shell 120 is spaced from shell 120, thereby assuring a predetermined minimum width of flue annulus between pot and shell—the same function served by spacing element 62 of strut 50 depicted in FIG. 1, FIG. 2. FIG. 3 and FIG. 4 and described hereinfore. Screw 100, seen most clearly in FIG. 11 and FIG. 12, serves as pot support, similar in function to that of pot support element 60 of FIG. 1, FIG. 2, FIG. 3, and FIG. 4., for instance. Projecting radially inward with respect to shell 120, pot support screw 100 is attached to strut 130 and secured by nut 109. Screw 100 may be of the flat head, countersunk type to allow strut 130 to lie flush against the inside surface of shell 120 when strut 130 is attached thereto.

Stud 94 and stud 96 are riveted to strut 98 and project radially outward with respect to shell 120. Stud 94, identical to stud 96, has an enlarged head 104 supported by stem 106 of lesser diameter than that of head 104 and of slightly smaller diameter than the width of slot 108 and slot 114 in shell fragments 90 and 92 so that studs 94 and 06 can slide freely along slots 108 and 114, respectively, Upper rim 110 of shell 120 incorporates slot 108 which extends from rim 110 downward into wall 124 of shell 120 a distance greater than the distance slot 114 in lower rim 112 of shell 120 extends upward from lower rim 112 into wall 124 of shell 120. This difference in lengths of slot 108 and slot 114 makes possible a procedure or method for attachment of strut 98 to shell 120, either in areas of single thickness of wall 124 of shell 120 or in areas of overlap and therefore double thickness as shown in FIG. 10, FIG. 11 and FIG. 12, which is essentially identical to that method and series of steps described hereinbefore and depicted in FIG. 5, FIG. 6 and FIG. 7. This novel method as it applies to the structure of FIG. 10, FIG. 11 and FIG. 12 may be described as follows.

Referring to FIG. 10, FIG. 11 and FIG. 12, shell fragments 90 and 92 are placed in faying relationship with respective slots 108 and 114 in each fragment in register or aligned, as shown, yielding the effect of a single slot in upper rim 110 of both shell fragment 90 and shell fragment 92. Stud 94, attached to strut 98 near upper end 130 thereof, is initially introduced into slot 108 with strut 98 oriented approximately parallel to the axis of tubular shell 120 and close to the inside surface of shell 120. Subsequently, stud 94 is moved along slot 108 toward lower rim 112 of shell 120 until stem 106 of stud 94 encounters end 122 of slot 108. In this relative position of strut 98 with respect to shell 120, lower stud 96, integral with strut 98, is positioned below or beyond lower rim 112 of shell 120 so that lower stud 96 can now be introduced into slot 114 in lower rim 112 of shell 120 and moved toward upper rim 110 of shell 120 until stem 106 of lower stud 96 encounters closed end 115 of slot 114. At this point, the relative positions of strut 98 and shell 120 are such that upper stud 94 is in an intermediate position along the length of slot 108 in upper rim 110 of shell 120, remaining in full engagement with shell 120. Thus, both upper and lower ends of strut 98 are secured to shell 120 by studs 94 and 96 in slots 108 and 114, respectively. With the stove assembly complete and resting on support surface 134 of FIG. 10 and FIG. 11, shell 120, by force of gravity, maintains an engaged relationship with strut 98 through upper stud 94 in slot 108 and through lower stud 96 in slot 114, the enlarged head 104 of each stud preventing escape from such mechanical arrangement.

It will be evident to one skilled in the art of such mechanical engagement means that either stud 94 or stud 96, or both stud 94 and stud 96, can be replaced by screw-and-nut fasteners. FIG. 24 depicts such alternate engagement means. Screw 95 is passed through hole 97, which is common to strut 98 and two thicknesses of shell 120, and a mating nut 99 is put on screw 95 but not tightened. The threaded shank of screw 95 can then be introduced into slot 108, such threaded shank serving in the same manner as stem 106 of stud 94, as shown with particular clarity in FIG. 11. After strut 98 is fully engaged, as previously described, such screw-and-nut fastener means can then be tightened to lock strut 98 and shell 120 together so that the engagement procedure is irreversible until such screw-and-nut fastener is loosened, as for disassembly of the stove. Such final securing of strut to shell by tightening of threaded fattener means, serving in lieu of stud 94 or stud 96 in the structure of FIG. 10, FIG. 11 and FIG. 12, represents an additional and final step supplementing the three-step method for attachment of strut 98 to shell 120 set forth above.

Of significance to that objective of the present invention to provide means for quickly and securely attaching struts to a shell without use of separate fasteners, that is, securing devices which are separate from the elements to be joined and therefore prone to loss or misplacement, is the fact that the mechanical arrangement depicted in FIG. 24 permits preliminary loose assembly of screw 95 with strut 98 by passing screw 95 through hole 97 in strut 98, and placement of nut 99 on screw 95 after such preliminary assembly so that screw 95 with nut 99 thereon cannot escape from strut 98 without nut 99 being removed. In such condition of preliminary loose assembly, the threaded shank of screw 95 can be slipped into slot 108, as illustrated in FIG. 24, with head 101 of screw 95 outside shell 120 and nut 99 inside strut 98. Thereafter, nut 99 can be tightened on screw 95 to clamp shell 120 and strut 98 tightly together. It should be further noted that, subsequent to preliminary assembly of nut 99 on screw 95, with screw 95 passed through hole 97 of strut 98, and with screw 95 protruding somewhat through nut 99, the threads on such protruding portion 103 of screw 95 can be deformed locally to prevent subsequent removal of nut 99 from screw 95 without deliberate effort, thus capturing nut 99 on screw 95 in essentially permanent assembly with strut 98 and thereby minimizing possibility of loss of such fasteners after assembly with strut 98, as in a factory or assembly facility.

Attention is directed to the fact that adjustability of effective shell diameter, to accommodate pots of differing diameters, in the strut and engagement means of FIG. 10, FIG. 11 and FIG. 12, as well as in the structure of FIG. 13 described hereinafter, may be provided by incorporating a plurality of slots as depicted in FIG. 25. FIG. 25 depicts fragment 119 of shell segment 127 including end 123 thereof, and fragment 121 of shell segment 129 including end 125 thereof. Upper rim 91 of shell fragment 119 incorporates slot 111 and slot 113 near end 123 of shell fragment 119, and upper rim 93 of shell fragment 121 incorporates slot 115 and slot 117 near end 125 of shell fragment 121. Slots 111 and 113 in upper rim 91 of shell fragment 119 are spaced apart so as to register with corresponding slots 115 and 117 of shell fragment 121 when shell fragment 119 is juxtaposed in faying relationship with shell fragment 121 and upper rim 91 of shell fragment 119 is aligned with upper rim 93 of shell fragment 121. Three possible relative positions of such pairs of slots present themselves, whereby incremental degrees of overlap of shell fragments 119 and 121 may be established. Least overlap will be seen to exist when slot 111 of shell fragment 119 registers with slot 117 of shell fragment 121. Maximum overlap pertains when slot 113 of shell fragment 119 registers with slot 115 of shell fragment 121. In an intermediate relative position of shell fragment 119 and shell fragment 121, slots 111 and 113 of shell fragment 119 can be positioned to register with slots 115 and 117, respectively, of shell fragment 121. Maximum overlap pertains when slot 113 of shell fragment 119 registers with slot 115 of shell fragment 121. In the case of tripartite construction of a shell to be used in a heater of the present invention, as depicted in FIG. 16 and FIG. 17, it will be understood that by such slotting of both upper and lower rims of each segment, thus providing three increments of overlap and therefore adjustment at each of three circumferential areas of overlap, a total of nine increments of adjustment of shell circumference, and therefore shell diameter, are provided.

Figure 13:
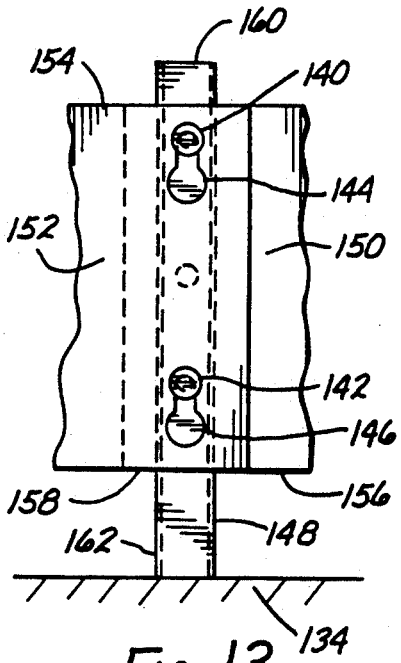
FIG. 13 is a frontal elevation view of a fragment of an alternate shell of a heater constructed according to the present invention and a strut attached thereto by alternate engagement means.

FIG. 13 depicts alternate means of attachment of a strut 148 to a shell 150 for assembly of a heater constructed according to the present invention and similar in certain respects to the structure of FIG. 10, FIG. 11 and FIG. 12. Strut 148, which may be substantially identical to strut 98 of FIG. 10, FIG. 11 and FIG. 12, includes upper stud 140 and lower stud 142, which studs may be identical to each other and to studs 94 and 96 of FIG. 10, FIG. 11 and FIG. 12. In lieu of upper slot 108 and lower slot 114 of FIG. 10, upper keyhole opening 144 and lower keyhole opening 146, respectively, are incorporated in overlapping shell fragment 154 and shell fragment 156 of shell 150. When overlapping portions of shell fragment 154 and shell fragment 156 are juxtaposed in faying relationship so that corresponding keyhole openings in each are in alignment with each other and correspond, stud 140 and stud 142, integral with strut 148, may be introduced simultaneously through keyhole openings 144 and 146, respectively, the enlarged portion of such keyhole openings being sized to accept the enlarged head portions of studs 140 and 142, as is the well-known practice in this class of fastening means. With studs 140 and 142 inserted in their respective keyhole openings 144 and 146, and with strut 148 in contact with shell 158, strut 148 may be moved in translation relative to shell 158 so that studs 140 and 142 move into the narrow portions of slots 144 and 146, respectively, until one or both studs contact the termination of their respective keyhole slots, at which point both upper end 160 of strut 148 and lower end 162 of strut 148 are securely engaged with shell 158. Enlarged head portions of stud 140 and stud 142 prevent their retraction from keyhole slots 144 and 146, respectively, when studs 140 and 142 are in this terminal position with respect to their respective slots.

It will be understood that disengagement of engagement means described herein and depicted in FIG. 1 through FIG. 13 may be effected readily by reversing the procedure and series of steps involved in effecting engagement of struts to shell. Such rapid and convenient means of assembling and disassembling the high performance heater of the present invention importantly enhances its utility as a highly transportable and portable heating device, especially important for disaster relief and use in remote or relatively primitive areas.

FIG. 14 and FIG. 15 depict a high performance heater of the present invention including outer shell segment 180 and outer shell segment 182, both arcuate members embracing shell 186 and resting on support surface 188, or, as precisely depicted in FIG. 14, resting on foot elements 190, 190' and 190" of struts 192, 192' and 192", respectively. Since the heater normally rests on a somewhat soft support surface such as the ground or sand, allowing foot elements of the struts to depress the support surface slightly, the small gap shown in FIG. 14 between the lower edges of shell segments 180 and 182 and support surface 188 disappears, so that, for all practical purposes, the only pathway for entry of air into combustion zone 4 within the heater is between shell 186 and outer shell segment 180 and between shell 186 and outer shell segment 182. As in the prior art heaters, outer shell segments 180 and 182 may be positioned so that end portions 194 and 194' of shell segment 182 overlap end portions 196 and 196' of shell segment 180, respectively, so that the only significant route of entry of combustion air into combustion zone 4 of the stove remains the openings between shell 186 and shell segments 180 and 182. Shell segments 180 and 182, not attached to shell 186 but in juxtaposition thereto, can be moved radially toward or away from shell 186 to provide less or more space for entry of combustion air and therefore highly effective draft control. Either outer shell segment 180, or outer shell segment 182, or both such shell segments, can also be moved rotationally about the axis of shell 186 so that a side port may be opened for insertion of fuel pieces, as for stoking a fire or for reigniting a fire which has died down. Handle means 184 clipped on to outer shell segment 182 provides convenient means for such movement or manipulation of shell segment 182, especially when a fire in the stove has heated such draft control means. The corresponding handle means for shell segment 180 has been omitted in the depictions of FIG. 14 and FIG. 15 for clarity of depiction. It will be understood by those familiar with the prior art that outer shell segments 180 and 182 may be varied in height above support surface 188 and relative to the height of flue shell 186 provided, for purposes of draft control, there is at least minimal overlap between the lower edge 198 of flue shell 186 and the upper edges of outer shell segments 180 and 182. For combined purposes of draft control and preheating of combustion air, such degree of overlap may be increased, as discussed extensively in prior art U.S. Pat. Nos. 4,915,091 and 4,722,322. However, it has been found in practice that outer shell or enclosure means providing for preheating of combustion air preferably extend upward to a level substantially below the upper rim of the flue shell, to assure adequate flow of air into the combustion zone, such as combustion zone 4 of FIG. 14 and FIG. 15. This is notably evident when small fires in the heater provide relatively weak convection to "pump" air down the intake passage between enclosure and flue shell.

FIG. 18 depicts a heater according to the present invention comprising shell 200 with upper rim 206 and lower rim 208, lower rim 208 resting on support surface 202. Pot support clips 230, 230' and 230" are depended from upper rim 206 by frictional engagement means 232, 232' and 232", respectively, spaced approximately 120° apart along rim 206 of shell 200. Shell 200 may be a single arcuate sheet of suitably heat-resistant material, such as readily flexed light gage sheet metal, or, in a preferred form of the invention, shell 200 may comprise arcuate segment 210 and arcuate segment 212 with overlapping edge portions 254 and 256, respectively, as seen with particular clarity in FIG. 20 and FIG. 21, such overlapping edge portions retained in faying juxtaposition by frictional engagement means 232" as best seen in FIG. 18. Arcuate segment 210 terminates at inwardly directed flange 214 at end 224 of arcuate segment 210, and, at its other end 226, arcuate segment 210 terminates at inwardly directed flange 216. Arcuate segment 212 terminates at inwardly directed flange 218 at end 228 of arcuate segment 212, and at its other end, segment 212 terminates at vertical edge 220 of end 222 of arcuate segment 212. As can be observed most clearly in FIG. 20 and FIG. 21, end 222 of arcuate segment 212 is without a flange, which allows arcuate segment 212 to lie in faying relationship with arcuate segment 210 of shell 200 in the area of overlap as depicted. Flanges 214, 216 and 218 provide not only stiffness to their respective ends 224 and 226 of arcuate segment 210 and end 228 of arcuate segment 212 but also serve the important function of spacing a pot seated an pot supports 240, 240' and 240" within shell 200 a predetermined minimum distance from the wall of shell 200, as discussed in detail below.

Shell 200 provides an opening 204 of variable width in the side of shell 200 by virtue of the fact that the degree of overlap of arcuate shell segments 210 and 212 may be varied at will, resulting in a greater or smaller distance between end 224 of shell segment 210 and end 228 of shell segment 212. Also, with employment of light gage, readily flexed sheet metal construction of shell 200, whether it be a unitary shell or a shell comprising two segments as depicted most clearly in FIG. 18, FIG. 20 and FIG. 21, opening 204 can vary from a relatively small width with shell 200 in a free state, that is, with no pot in place within shell 200, to a considerably greater width with shell 200 sprung, by virtue of its yielding nature, to a larger effective diameter by placement of a pot within shell 200 which forces shell 200 to expand. Such enlargement of shell 200, to accommodate pots through a range of diameters, is depicted by FIG. 20 and FIG. 21. FIG. 20 shows in top plan view in schematic outline a pot 260 in contact with flange 214 and flange 216 of shell segment 210 and also in contact with flange 218 of shell segment 212. FIG. 21 depicts a pot 270, in top plan view in schematic outline, of larger diameter than that of pot 260 of FIG. 20. Pot 270, like pot 260, is in contact with the vertical edges of flanges 214, 216 and 218, which vertical flanges 214, 216 and 218 have been urged radially outward by pot 270 along with shell 200 which flexes or yields to a larger effective diameter to accommodate the greater diameter of pot 270 relative to the diameter of pot 260 of FIG. 20. Annular flue space 250 between either smaller pot 260 of FIG. 20 or larger pot 270 of FIG. 21 and shell 200 is therefore maintained with pots in a range of diameters which may be used with a heater of the present invention.

Opening 204 in shell 200 provides access to combustion zone 290 within shell 200 and beneath a pot such as pot 260 of FIG. 22. Such access is necessary for free flow of combustion air into combustion zone 290 to support a fire or burning fuel of any sort. Opening 204 may be readily adjusted to insertion of fuelwood pieces for building and maintaining a fire within combustion zone 290. Opening 204 in shell 200 may also be sized to accommodate ready insertion and removal of a fuel canister, or a plurality of such canisters, of jelled fuel or liquid fuel such as diethylene glycol. Such a canister 280 is depicted in FIG. 22, employing a wick as is common practice for heating of liquids and foodstuffs. Products of combustion from a flame or flames within combustion zone 290 rise around pot 260, for instance, as shown in FIG. 22, largely surrounded by and sheltered by shell 200, and exhaust primarily through annular flue space 250 between pot 260 and shell 200. Shell 200 largely embraces pot 260 to provide shelter from ambient wind and to confine hot products of combustion in close proximity to pot 260, whereby enhanced efficiency of heat transfer to pot 260 is realized. Because of sheltering of flames from wind, it is practical to employ a heater of the present invention under outdoor conditions rendering unsheltered burners impractical.

Pot spacing means, alternate to flanges 214, 216 and 218 discussed above, may be provided by pot spacing element 234 of clip 230, best seen in side elevation view FIG. 19 in which shell segment 210 of shell 200 has been cut away to reveal clearly the several elements of clip 230 in its clamping relationship with rim 206 of shell 200. Clip 230 comprises outer clip element 232 joined to and biased toward inner clip element 238 by intermediate bend element 236, pot spacing element 234 which extends from inner clip element 238 to bend 242 joined to pot support element 240. Pot spacing element 234 comprises upper guide element 242 and lower guide element 244 joined at bend 246 which, when clip 230 is installed on shell 200, is spaced away from wall 246 of shell segment 210 a distance which determines the spacing of a pot, such as pot 260 depicted in FIG. 22 and depicted schematically in plan view in FIG. 20 and FIG. 21, away from wall 246 of shell 200. Unitary pot support and pot spacing clips 230, 230' and 230" therefore predetermine the width of annular flue space 250 between wall 246 of shell 200 and any pot situated within the confines of shell 200, provided such pot is of diameter at least to make contact with pot spacing elements 234, 234' and 234" of clips 230, 230' and 230", respectively. FIG. 21 depicts schematically pot 270, of larger diameter than pot 260 of FIG. 20, bearing against pot spacing elements 234, 234' and 234" to cause shell 200 to expand yieldingly with the result that opening 204 between edge 224 of shell segment 210 and edge 226 of shell segment 212 has been expanded in width correspondingly. It is to be noted that either pot spacing elements 234, 234' and 234" of clips 230, 230' and 230", respectively, or flange elements 214, 216 and 218 of shell 200 may serve the function of maintaining a minimum width of flue annulus 250 through a range of diameters of pot which may be employed with a heater of the present invention. Shell 200 fabricated without flange elements 234, 234' and 234" but equipped with unitary pot support and pot spacing clips 230, 230' and 230" spaced about upper rim 206 approximately 120° apart as depicted in FIG. 18, FIG. 19, FIG. 20 and FIG. 21, serves all requisite functions and objectives of the present invention. Pot support elements 240, 240' and 240" predetermine the height of the bottom of a vessel within shell 200 above support surface 202, so that the flame of combustion heat source 280 depicted in FIG. 22 as also resting on support surface 202, such as a table, can burn efficiently. It has been found by experiment that height of a pot above a diethylene glycol burner, for instance, similar to that heat source 280 depicted in FIG. 22, is critical for achieving combustion with minimum soot residue an the bottom of the pot. In fact, at optimum height of pot above flame of such burners, combustion is virtually soot-free.

FIG. 23 depicts, in side elevation view partly in section, a fragment of a shell 300 similar to shell 200 of FIG. 18, FIG. 19, FIG. 20, FIG. 21 and FIG. 22 but with multi-functional wireform or strip metal unitary device 310 attached to shell 300 by upper engagement means or hook 312 and lower engagement means or catch 326. Hook 312 engages upper rim 302 of shell 300, and catch 326 engages or snaps under lower rim 304 of shell 300. Installation of unitary device 310 on shell 300 is accomplished by initially engaging hook 312 over upper rim 302 and subsequently snapping catch 326 under lower rim 304 by means of ramp element 328 of catch 326 which slides under rim 304 as catch 326 is forced into engagement with lower rim 304. Unitary device 310, comprising in part pot support element 320, bend 332 and brace element 330, provides the necessary yielding quality or spring means to allow lower engagement means or catch 326 to move downward slightly as ramp element 328 slides under rim 304 of shell 300. Pot spacing element 318 of unitary device 310 is spaced from wall 334 of shell 300 by diagonal element 314 joined with upper engagement means or hook 312 at bend 336 and with pot support element 320 at bend 338. Brace element 330 is joined to pot support element 320 through bend 332' and bears against wall 334 of shell 300 at juncture 340 with upright element 324 of unitary device 310. Pot spacing element 318 therefore maintains a fixed spacing from wall 334 of shell 300. Unitary device 310 serves the same functions as clip 230, clip 230' and clip 230" of FIG. 18, FIG. 19, FIG. 20, FIG. 21 and FIG. 22. It will be understood that a plurality of unitary device 310 spaced at approximate 120° intervals about rim 302 of shell 300 can support a pot much as illustrated in FIG. 22.

Figure 26:
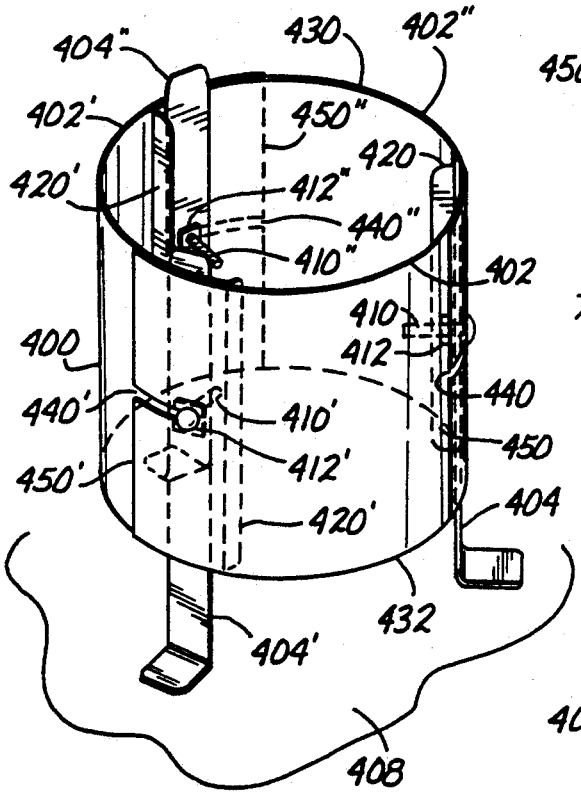
FIG. 26 is an isometric view taken from above a combustion heater constructed according to the present invention.
Figure 27:
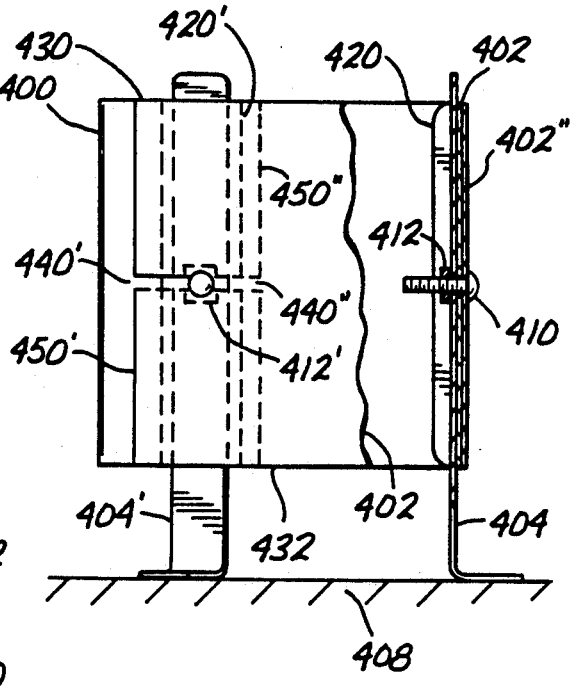
FIG. 27 is a side elevation view partially in section of the heater depicted in FIG. 26.
Figure 28:
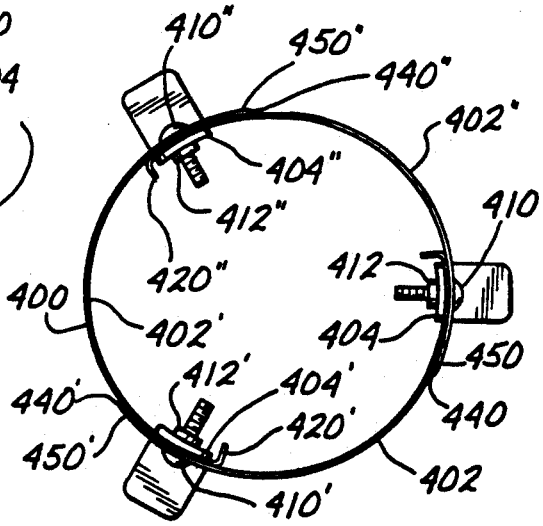
FIG. 28 is a top plan view of the heater depicted in FIG. 26 and FIG. 27.

FIG. 26, FIG. 27 and FIG. 28 depict a heater constructed according to the present invention including tripartite cylindrical shell 400 with upper rim 430 and lower rim 432 and comprising three identical arcuate segments 402, 402' and 402". Shell 400 is elevated above support surface 408 by three identical struts 404, 404' and 404". Struts 404, 404' and 404" are attached to shell 400 by screws 410, 410' and 410", respectively, which are secured by nuts 412, 412' and 412". respectively. Screws, 410, 410' and 410" pass through holes in struts 404, 404' and 404", respectively, as well as through apertures in overlapping areas of shell segments 402, 402' and 402", as can be seen most clearly in FIG. 27 in which shell segment 402 has been cut away to reveal a section through the heater of the present invention taken in a vertical plane including the centerline of screw 410.

Embodiments of the invention depicted in FIG. 1 through FIG. 15 involve structures in which each strut is attached to the heater shell at two points, one means of engagement adjacent the upper rim of the shell, and a second means of engagement adjacent the lower rim of the shell, thus stabilizing the struts as well as securing the shell, or shell segments in the case of heater shells comprising a plurality of arcuate segments, at a desired effective diameter, as previously discussed herein. In contradistinction to those previously discussed and depicted embodiments, the embodiment of FIG. 26, FIG. 27 and FIG. 28 incorporates structures in which a single screw-and-nut fastener at each area of overlap of shell segments 402, 402' and 402" suffices both to fix the overlapping portions of adjacent shell segments but also to retain the strut at each such overlapping portion in a stable relationship to shell 400. Identical shell segments 402, 402' and 402" incorporate inwardly directed vertical flange elements 420, 420' and 420", respectively. Flange elements 420, 420' and 420" serve the dual functions of spacing a pot placed in shell 400, for heating a substance, from the wall of shell 400, to provide a minimum annular space or flue between such pot and shell 400 for exhaust of products of combustion from a fire within shell 400 and beneath such pot, and stabilizing struts 404, 404' and 404", respectively, in an attitude substantially parallel to the axis of shell 400. Since each strut lies closely adjacent a flange, as best seen in FIG. 28, and extends from above upper rim 430 of shell 400 to below lower rim 432 of shell 400, it is impossible for strut 404, 404' or 404" to rotate significantly with respect to the axis of cylindrical shell 400 when secured to shell 400 by screw 410, 410, and 410", respectively, and nut 412, 412' and 412", respectively. Elongate screws 410, 410' and 410" project radially inward in shell 400 farther than such radial inward projection of flange elements 420, 420' and 420", whereby screws 410, 410' and 410", located approximately midway between upper rim 430 of shell 400 and lower rim 432 of shell 400, serve as pot support means as well as engagement means for securing integrated assembly of the heater of the present invention. In their function of pot support means, screws 410, 410' and 410" space a pot resting thereon a predetermined height above support surface 408 and therefore above a fire within the stove and also resting on support surface 408, whereby efficient combustion may be assured.

Identical shell segments 402, 402' and 402" incorporate horizontal slots 440, 440' and 440", respectively, in ends 450, 450' and 450", respectively, of shell segments 402, 402' and 402" respectively. Slots 440, 440' and 440" are of sufficient width to allow screws 410, 410' and 410" to pass through freely but not allow the broad heads of screws 410, 410' and 410" to pass, as depicted with particular clarity in FIG. 27 and FIG. 28. Thus, when screws 410, 410' and 410" are in place, as depicted in FIG. 26, FIG. 27 and FIG. 28, and nuts 412, 412' and 412", respectively, are installed but not tightened, the overlapping shell segments can be moved circumferentially with respect to each other, thereby altering or adjusting the effective diameter of shell 400 as may be required to adapt shell 400 to a given pot to be used with the heater of the present invention. Such adaptation is facilitated by placing the given pot to be used on support screws 410, 410' and 410" with nuts 412, 412' and 412" not tightened and sliding the faying portions of shell segments 402, 402' and 402" with respect to each other until flange elements 420, 420' and 420" are nearly in contact with the pot, so the pot can slide vertically without binding. After removing the pot with shell 400 thus adjusted to the desired diameter, screws 410, 410' and 410" with nuts 412, 412' and 412" can be tightened to lock all components of the heater in a sturdy, integrated assembly. It will be obvious to one skilled in the art that slots 440, 440' and 440" can be replaced by a plurality of holes of suitable diameter spaced along the respective centerlines of slots 440, 440' and 440" to provide circumferential adjustablity of shall 400 similar to that provided by slots 440, 440' and 440" but with incremental adjustment potential rather than continuous adjustment capability as provided by slots 440, 440' and 440" of shell segments 402, 402' and 402". It will be further understood that the heater of FIG. 26, FIG. 27 and FIG. 28 can be complemented by combustion air preheat/draft control shells as hereinbefore described and depicted in FIG. 14 and FIG. 15.

While a number of embodiments of the present invention have been set forth and depicted for purposes of explanation and clarity, further changes and modifications and substitutions will become apparent to those possessed of ordinary skill in the art without departing from the spirit and scope of the present invention, which is defined only by the following claims.

What is claimed is:

1. A fuel burning heater comprising:

a substantially cylindrical shell having an upper rim and a lower rim, at least the lower portion of said shell defining a combustion zone, a plurality of strut means for resting on a support surface, such as the ground, and supporting said shell so that said lower rim is elevated above said support surface to provide a circumferential opening between said lower rim and said support surface for flow of combustion air into said combustion zone, said strut means extending unitarily within said shell from below said lower rim to a level adjacent said upper rim, a heat source disposed within said combustion zone, and said strut means including means for attachment to said shell whereby said strut means are fixed substantially normal to said upper rim and said lower rim.

2. The combination of claim 1 in which said means to attach said strut means include first engagement means for support of said shell adjacent said lower rim and second engagement means for engaging said shell adjacent said upper rim.

3. The combination of claim 2 in which said first engagement means of each strut means includes jamming means whereby said lower rim of said shell may be driven into binding relationship with said strut means for frictionally fixing said strut means to said shell.

4. The combination of claim 2 in which said second engagement means of each strut means includes yielding means for movably gripping said shell adjacent said upper rim.

5. The combination of claim 2 in which at least one of each of said first engagement means and said second engagement means includes fastener means whereby said strut means may be locked to said shell.

6. The combination of claim 2 in which the space relationship of said first engagement means relative to said second engagement means is such that translational movement of said strut means in a first direction serves to engage said second engagement means with said upper rim of said shell, and translational movement of said strut means relative to said shell in a second direction substantially opposite to said first direction serves to engage said first engagement means with said lower rim of said shell.

7. The combination of claim 2 in which translational movement of at least one of said engagement means of each of said strut means relative to said shell serves to engage said engagement means with said shell.

8. The combination of claim 2 in which said shell includes aperture means for cooperation with said engagement means.

9. The combination of claim 8 in which said aperture means include slot means for cooperation with said engagement means associated with said strut means.

10. The combination of claim 1 in which said strut means include upper ends which extend above said upper rim for support of a utensil of a diameter larger than that of said shell, whereby products of combustion from said heat source may escape upwardly from said combustion zone when a utensil is disposed on said upper ends of said strut means.

11. The combination of claim 1 including container means supported at least partially within said shell and defining therewith an exhaust flue surrounding said container means for hot products of combustion rising from said heat source.

12. The combination of claim 11 in which said shell comprises a plurality of overlapping arcuate segments.

13. The combination of claim 12 in which said overlapping arcuate segments include inwardly directed flange means for spacing said container means from said shell.

14. The combination of claim 13 in which said flange means include means for support of said container means.

15. The combination of claim 13 in which said means to attach said strut means to said shell include means to support said container means a predetermined height above said support surface.

16. The combination of claim 13 in which said strut means are attached to said shell adjacent said flange means, whereby said strut means are prevented by said flange means from substantial movement relative to said flange means.

17. The combination of claim 12 in which said overlapping arcuate segments are retained in faying juxtaposition by said means to attach said strut means to said shell.

18. The combination of claim 12 in which said arcuate segments include aperture means cooperating with said means to attach said strut to said shell, whereby said arcuate segments may be attached to said strut means at a plurality of circumferential locations relative to each other.

19. The combination of claim 18 in which said aperture means include slot means oriented substantially parallel to said upper rim and said lower rim of said shell.

20. The combination of claim 11 in which said strut means include means unitary therewith for support of said container means.

21. The combination of claim 11 in which said strut means include means unitary therewith for spacing said container means from said shell.

22. The combination of claim 1 in which translational movement of said strut means relative to said shell serves to attach each of said strut means to said shell.

23. The combination of claim 1 in which closure means are provided to surround said circumferential opening and in which said closure means may be opened selectively to vary the rate of flow of combustion air entering said combustion zone.

24. The combination of claim 23 in which said closure means surrounding said circumferential opening comprise arcuate means movable with respect to said shell, whereby draft of air entering said combustion zone may be controlled.

25. The combination of claim 23 in which said cylindrical shell extends above said closure means.

26. The combination of claim 1 including enclosure means surrounding said heater, said enclosure means resting on said support surface and extending upward to a level below said upper rim of said shell.

27. The combination of claim 1 including enclosure means surrounding and spaced from said heater, whereby combustion air entering said combustion zone flows downward between said enclosure means and said shell before entering said circumferential opening, said enclosure means extending from said support surface to a level below the level of said upper rim of said shell.

28. In a fuel burning heater, the combination of a truncated tubular flue, said flue having an upper rim and a lower rim, a plurality of strut means for elevating said flue above a support surface such as the ground, said strut means extending unitarily within said flue from below said lower rim to a level adjacent said upper rim and including means for attachment to said flue whereby said strut means are fixed substantially normal to said upper and lower rims, and means for spacing a pot situated at least partially within said flue from said flue to provide a predetermined minimum space for exhaust of products of combustion, said means for spacing comprising an inwardly extending segment of said strut means.

29. The combination of claim 28 in which said flue is adjustable in diameter to accommodate pots within a range of diameters.

30. The combination of claim 28 including enclosure means surrounding and spaced from said truncated flue, said enclosure means extending from said support surface to a level below a plane defining the upper end of said truncated flue.

31. A method of removably attaching an elongate structural member to a sheet member having a first edge substantially parallel to, and spaced apart from, a second edge, said structural member being at least as long as the distance between said first edge and said second edge of said sheet member and including first engagement means adjacent a first end of said structural member and second engagement means adjacent a second end of said structural member, said method including the steps of:

a. juxtaposing said structural member to said sheet member in an attitude substantially normal to said first edge and to said second edge of said sheet member, b. engaging said first engagement means with said first edge of said sheet member by translational movement of said structural member in a direction substantially normal to said first edge of said sheet member, and c. engaging said second engagement means with said second edge of said sheet member by translational movement of said structural member in a direction substantially opposite to the direction of movement of said structural member relative to said sheet member in step b.

32. The method of claim 31 in which said sheet member is in the form of a truncated cylinder, and said structural member is a strut for support of said sheet member above a support surface, such as the ground.

33. The method of claim 32 including the subsequent step of securing at least one of said first engagement means and said second engagement means against inadvertent disengagement.

34. A combustion heating system comprising:

a pot for containing substances for heating, a heat source disposed beneath said pot and resting on a support surface such as the ground, a truncated flue to confine convective products of combustion from said heat source within said flue, said pot disposed substantially within said flue, a plurality of unitary strut means for elevating said flue above said support surface whereby a peripheral aperture for intake of combustion air is provided, said unitary strut means including (a) means for attaching said strut means to said flue, (b) means for supporting said pot a predetermined height above said support surface, and (c) means for spacing said pot within the confines of said flue whereby an opening is provided between said pot and said flue for exhaust of products of combustion.

35. The combination of claim 34 in which said unitary strut means includes means for supporting a utensil of diameter greater than that of said flue at a level above said flue whereby products of combustion may escape from said flue when said utensil is positioned for heating.

36. The combination of claim 34 in which said flue is adjustable in diameter whereby pots of varying diameter may be accommodated within the confines of said flue.

37. The combination of claim 34 including a plurality of selectively movable arcuate closure means surrounding said peripheral aperture whereby flow of combustion air through said aperture may be regulated.

38. The combination of claim 37 in which said closure means embrace a substantial portion of said flue whereby combustion air flowing between said closure and said flue is preheated before entering said aperture.

39. The combination of claim 34 including enclosure means surrounding and spaced from said truncated flue, said enclosure means resting on said support surface and extending upward to a level below the upper limit of said truncated flue.

40. A combustion heating systems comprising:

a vessel for containing foodstuffs or liquids for heating, having a bottom and side wall, a heat source disposed beneath said vessel, a flue to confine convection products of combustion from said heat source within said flue, said flue including aperture means for intake of combustion air, said vessel being disposed substantially within said flue, and means for spacing said vessel from said flue, said means being disposed to contact said side wall, whereby a generally annular opening between said vessel and said flue is provided for exhaust of said products of combustion.

41. The combination of claim 40 in which said flue is adjustable in diameter to accommodate vessels of differing diameters.

42. The combination of claim 40 including enclosure means surrounding and spaced from said flue, said flue extending above said enclosure means.

43. A fuel burning heater comprising:

a container of substantially circular planform having a bottom and a side wall a heat source beneath said container and resting on a support surface, a substantially circular shell resting on said support surface and largely embracing both said container and said heat source, said shell being apertured for intake of combustion air, means dependent from said shell for support of said container a predetermined height above said support surface, and means for spacing said container from said shell said means being disposed in contact with said side wall to provide an annular flue for convective flow of hot gases rising from said heat source.

44. The combination of claim 43 in which said means for spacing are unitary with said means for support of said container.

45. The combination of claim 43 in which said means for spacing are unitary with said shell.

46. The combination of claim 43 in which said shell comprises yielding means whereby said shell may accommodate containers within a range of diameters.

47. The combination of claim 43 in which said shell comprises a plurality of yielding arcuate segments.

48. The combination of claim 43 in which said shell is yieldingly responsive to said means for spacing in assuming its effective diameter for embracing said container.

49. A fuel burning heater comprising:

a substantially cylindrical wall having an upper rim and a lower rim for resting on a support surface, said wall including aperture means for intake of combustion air, a heat source disposed on said support surface and within the confines of said wall, and means associated with said wall to support a vessel within the wall at a predetermined height above said support surface, said means to support including means unitary therewith for spacing said vessel a predetermined distance from said wall whereby hot gases rising from said heat source may flow by convection between said vessel and said wall.

50. The combination of claim 49 in which said means for support include first means for engaging said upper rim and second means for engaging said lower rim.

51. The combination of claim 50 in which said means for support include yielding means whereby the distance between said first means and said second means may be increased by flexing of said means for support.

* * * * *